US005730437A

United States Patent [19]

Boyadjian

[11] Patent Number: 5,730,437

[45] Date of Patent: Mar. 24, 1998

[54] METHOD OF, AND APPARATUS FOR, PROCESSING BUNDLES OF CONGRUENT SHEETS OF A FLAT MATERIAL

[76] Inventor: Hratch Boyadjian, Obstgartenstrasse 8, CH-8703 Erlenbach, Switzerland

[21] Appl. No.: 716,379

[22] PCT Filed: Jan. 16, 1996

[86] PCT No.: PCT/CH96/00018

§ 371 Date: Nov. 18, 1996

§ 102(e) Date: Nov. 18, 1996

[87] PCT Pub. No.: WO96/22243

PCT Pub. Date: Jul. 25, 1996

[30] Foreign Application Priority Data

Jan. 20, 1995 [CH] Switzerland ..... 154/95

[51] Int. Cl.[6] ..... B65H 39/02

[52] U.S. Cl. ..... 270/58.07

[58] Field of Search ..... 270/58.01, 58.07, 270/58.08

[56] References Cited

U.S. PATENT DOCUMENTS

| | | | |
|---|---|---|---|
| 3,635,463 | 1/1972 | Stobb | 271/6 |
| 5,101,610 | 4/1992 | Honegger | 53/430 |
| 5,497,985 | 3/1996 | Byttebier et al. | 271/7 |

*Primary Examiner*—John T. Kwon

*Attorney, Agent, or Firm*—Finnegan, Henderson, Farabow, Garrett & Dunner, L.L.P.

[57] ABSTRACT

An apparatus and method of preparing bundles for binding, where the method is carried out at a high processing frequency and the device is of a compact construction, where bundles of sheets are raised from the upper end of a supply stack of a punching device in a continuous manner by means of an engagement tool and the respective bundle is displaced by a pusher, with the result that its opposite border region projects into a punching device and is processed there. Lifting edges of two rotating disc segments then engage beneath the opposite border of the bundle, the border being retained by the pusher, and raise the border until the region adjoining it is clamped between partially cylindrical clamping surfaces of the disc segments, the clamping surfaces adjoining the lifting edge, and a likewise rotating clamping roller, and the bundle is fed, counter to the displacement direction, to a transportation device, where the bundles are clamped between two pairs of transporting belts and are transported to an end stack. The bundles are turned at the same time they are transported. The bundles follow one after the other at a distance which is smaller than the width of a bundle, with the result that they overlap in an imbricated manner.

33 Claims, 9 Drawing Sheets

METHOD OF, AND APPARATUS FOR, PROCESSING BUNDLES OF CONGRUENT SHEETS OF A FLAT MATERIAL

BACKGROUND OF THE INVENTION

1. Field of the Invention

The present invention relates to a method and apparatus for processing paper sheets which are punched or stamped, e.g. in order to prepare them for binding. In this case, the sheets are removed automatically from a supply stack in bundles of a specific thickness, e.g. a few millimeters, processed, turned and fed to an end stack.

2. Description of the Related Art

Apparatuses of the generic type are known (see for example, the Lloyd Machinery Ltd. brochure: Automatic Punching Machine, Model 340), where a bundle to be processed is drawn out to its full extent from the supply stack, in each case in the direction of a punching device, is turned by means of a transportation device, punched in a border region and, finally, deposited on an end stack.

In this procedure, a bundle follows the preceding bundle at a distance which—depending on the alignment of the punching device—corresponds at least to the length or width of the preceding bundle. As a result, on account of transportation-related delays, the processing device does not operate at the frequency which is possible in principle and the throughput of the apparatus remains comparatively low. Moreover, the construction of the apparatus requires a large amount of space.

SUMMARY OF THE INVENTION

This invention is intended to remedy the problems of low throughput and large space requirements common to known machines in the art. According to the present invention, a method is provided in which the bundle to be processed is shifted with respect to the supply stack, for processing purposes, by not much more than the width of the edge region which is to be processed. Likewise, it is drawn back by only approximately the same distance in order to free the processing device for the following bundle, which is thereupon brought into the processing position without the first-mentioned bundle having to be removed to the full extent beforehand. One object of the invention is to vastly reduce the risk of electrostatic charging, which may be very disruptive, in particular with use of certain films.

While being compact, the construction of the apparatus according to the invention makes it possible for the method according to the invention to be implemented reliably and quickly.

BRIEF DESCRIPTION OF THE DRAWINGS

The invention is explained in more detail hereinbelow with reference to figures, which merely illustrate an exemplary embodiment and in which.

DETAILED DESCRIPTION OF THE PREFERRED EMBODIMENT

Figure 1A:
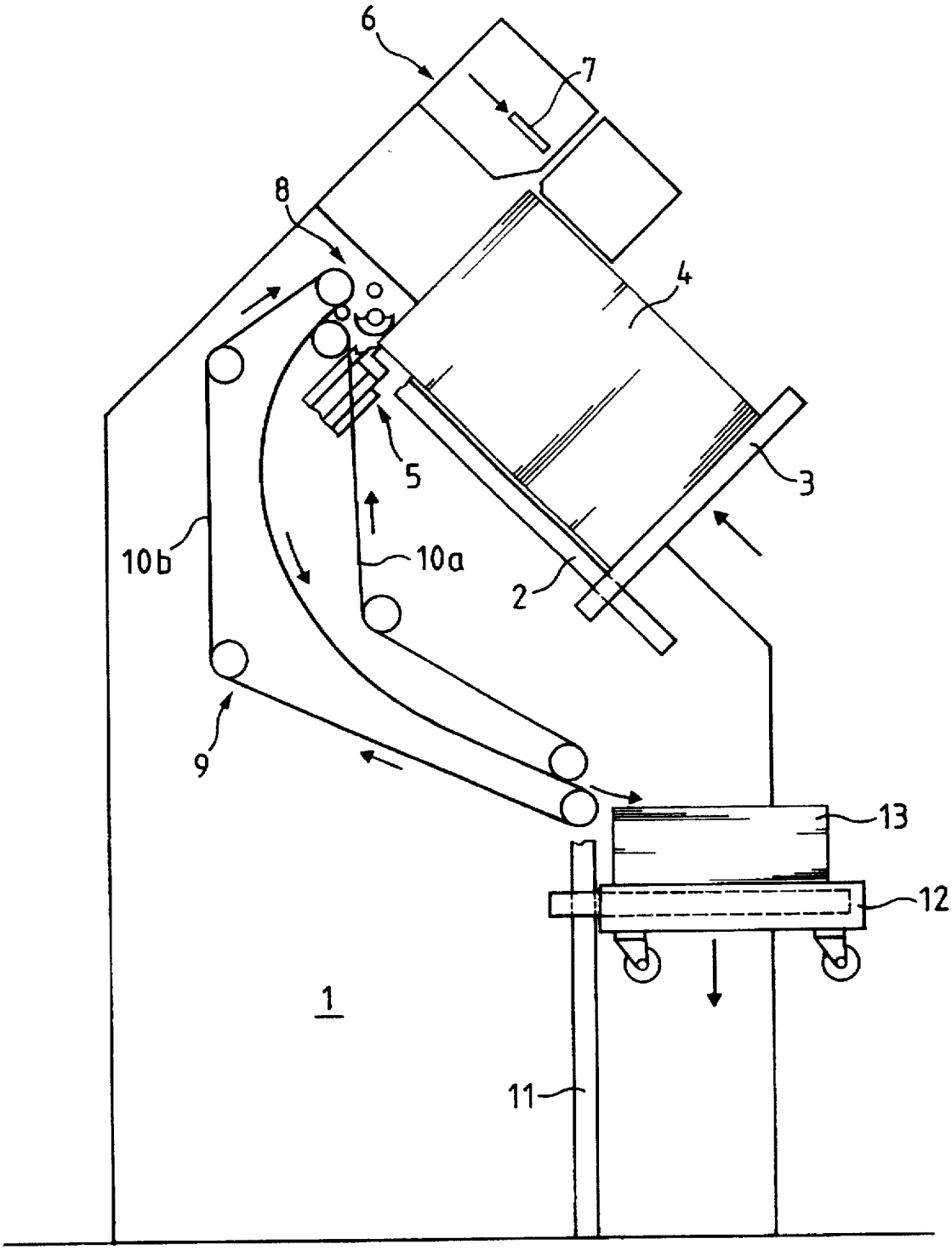
FIG. 1*a* shows a schematic side view of an apparatus for processing bundles of sheets in preparation for binding according to the invention.

The apparatus has (FIG. 1*a*), in a housing 1, an oblique guide rail 2 along which a first stack base 3 can be displaced. The first stack base bears a supply stack 4 of sheets which are located one atop the other and are supported laterally by the guide rail 2. At one side of the upper end of the guide rail 2, a shifting tool in the form of a pushing device 5 is arranged and, as a processing tool, a punching device 6, whose distance from the pushing device 5 can be adjusted and which has a plurality of punches 7 which are arranged in a row and can be moved up and down, is arranged on the side opposite the pushing device 5.

A withdrawal device 8, which is directly adjoined by a transportation device 9, is provided above the pushing device 5. The withdrawal device 8 comprises two continuous belt pairs 10*a*,*b* which are guided in parallel via a transporting section of the apparatus which describe an arc of approximately 180°. The belt pair 10*a* runs along the transporting section via a convex guide, e.g. made of sheet aluminium. Arranged beneath the end of the transporting section is a second, vertical guide rail 11 along which it is possible to displace vertically a second stack base 12 for receiving an end stack 13. The stack base 12 is provided with wheels.

In broad outlines, the method of using the apparatus according to the invention is as follows:

The stack base 3 is displaced upwards by the thickness of a bundle of sheets which is to be processed, the uppermost bundle of the supply stack 4 is then shifted by means of the pushing device 5 such that its edge region which is to be processed in preparation for binding is located in the punching device 6, the edge region is punched and the bundle is gripped by the withdrawal device 8 and fed to the end stack 13 by the transportation device 9, at the same time being turned in order to maintain the order of the sheets. The above-described design of the transportation device 9 also makes it possible to transport comparatively rigid sheets since the transporting section has a large radius of curvature, something which could be achieved only with an incomparably larger amount of space in the case of conventional, drum-based transportation devices. Successive bundles are processed and transported in an overlapping manner. In the process, the stack base 12 is lowered such that the upper end of the end stack 13 always remains just beneath the level of the outlet of the transportation device 9. As soon as the stack base 12 reaches the floor region, the punching device stops. The stack base 12 can then be lowered onto the floor, disengaged and rolled away with the end stack 13.

Figure 1B:
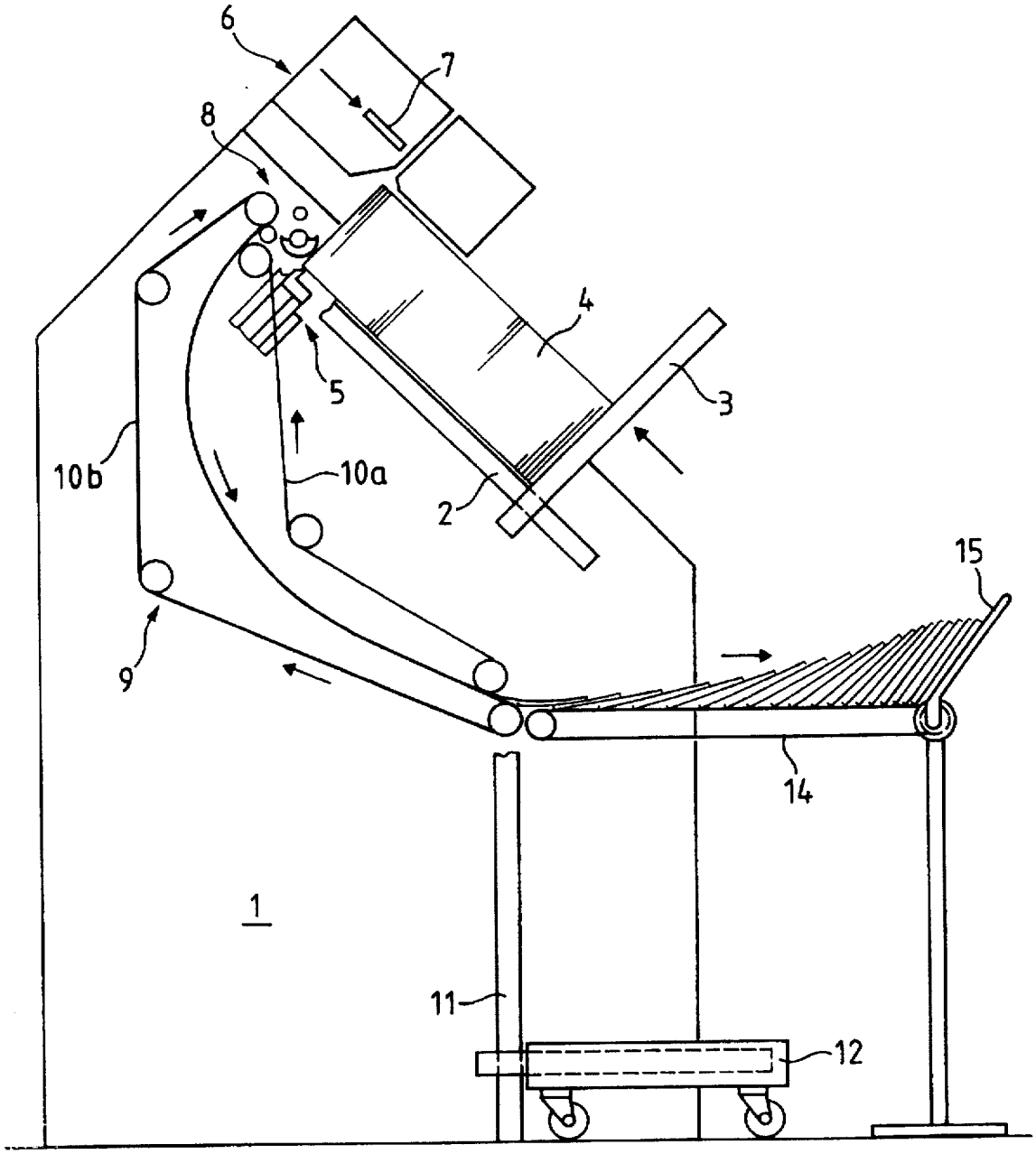
FIG. 1*b* shows a side view corresponding to FIG. 1*a*, in which case the apparatus has been converted and modified for the processing of small-format sheets.

In the case of small-format sheets, the distance of the punching device 6 from the pushing device 5 is reduced appropriately (FIG. 1*b*). Since such sheets are usually difficult to stack in the above-described manner, a conveying belt 14 which adjoins the transportation device 9 and can be coupled to the transportation device 9, for example, via gear wheels is provided. At the end which is directed away from the transportation device 9, the conveying belt has a receiving plate 15 against which the bundles are accumulated and aligned. When the conveying belt 14 is full, it is emptied. Otherwise, the processing of the sheets takes place as has been outlined above. It is also possible for the conveying belt 14 to transport the sheets directly to another device for the purpose of further processing. In this case, the receiving plate 15 is omitted.

Figures 2, 2A:
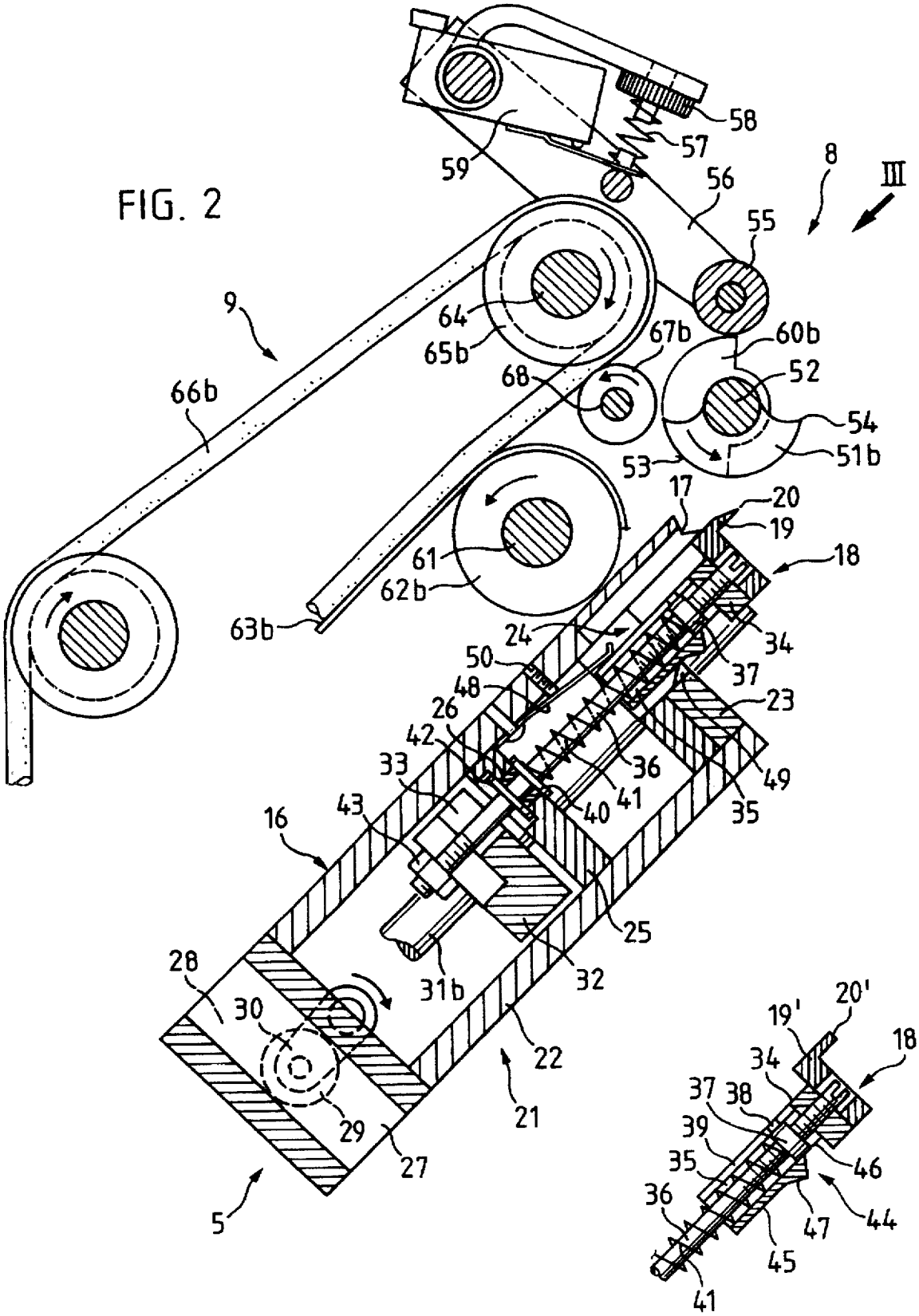
FIG. 2 shows, on an enlarged scale, a longitudinal section through part of the apparatus of FIGS. 1*a*, 1*b*.
FIG. 2*a* shows a side view of a modified embodiment of a constituent part of the part of the apparatus according to FIG. 2.

As can best be seen from FIG. 2, the pushing device 5 comprises a pusher 16, which is advanceable and retractable transversely with respect to the supply stack 4 such that, in the end position, it projects over the stack base 3. At the front end, the pusher 16 is provided with a concave thrust surface 17. The thrust surface 17 is formed by two strips which are inclined inwards to some extent from the upper and lower ends and enclose an obtuse angle. The pushing device 5 further includes an engagement tool 18 with an exchangeable nose 19 for engagement in the supply stack 4, which engagement tool can be advanced and drawn back in the same way as the pusher 16. According to FIG. 2, the nose 19 has a cutting edge 20 at its front end. This design is suitable for the processing of sheets of comparatively thin material, such as paper, since the cutting edge 20 can, in this case, penetrate readily between two sheets located one above the other.

However, in the case of thicker material such as cardboard, a cutting edge could cut into the side border of one of the sheets, which could disrupt the processing sequence and also result in the cardboard being damaged. Therefore, for the processing of material of this type, a nose 19' is mounted with a low end surface 20' with transverse grooves in the engagement tool 18, as is illustrated in FIG. 2*a*.

The engagement tool 18 is mounted, such that it can be displaced to a limited extent in the advancement direction, in a mount 21 which is fastened on the underside of the pusher 16. The mount 21 comprises a base plate 22 which is parallel to the pusher 16 and bears, on the front border, a front wall 23, with a central recess 24 which is cut in from the upper border of said front wall and through which the engagement tool 18 projects, and an intermediate wall 25 further to the rear, the latter connecting said base plate to the pusher 16 and having a lead-through 26. A terminating double rear wall 27 forms a groove 28 which is aligned perpendicularly with respect to the advancement direction and in which a carry-along roller 29 of a crank 30 engages. The laterally open mount 21 is fitted displaceably on two carrying rods 31*a,b* parallel to the advancement direction. Projecting through the space between the intermediate wall 25 and the rear wall 27 is a bar 32 which is fastened on the carrying rods 31*a,b* and has a slot 33 which is cut in from its upper border.

The engagement tool 18 has a housing 34 (see also FIG. 2*a*), on the front side of which the nose 19 is screwed on centre. The pregripper housing 34 has running through it, in the advancement direction, a bore 35 which surrounds and is spaced from a bolt 36, the foremost section of said bolt being mounted in the housing 34 such that it can be rotated but not displaced. Its front end is accessible from the front side of the engagement tool 18 and is provided with a slot for the engagement of a screwdriver. That section of the bolt 36 which projects through the bore 35 bears a thread which engages with an adjustment nut 37. The nut 37 can be displaced with respect to the housing 34, but, due to a pin 38 which engages in a slot 39 connecting the bore 35 to the upper side of the housing 34, it cannot be rotated. The rear part of the bolt 36 projects through the lead-through 26 in the intermediate wall 25 and through the slot 33 in the bar 32. In the lead-through 26, the bolt 36 can be displaced and tilted to a limited extent, but otherwise said bolt is guided substantially without play; the slot 33 allowing it a small amount of lateral play.

A helical spring 41 which surrounds the bolt 36 is arranged between the adjustment nut 37 and a supporting ring 40, which is seated displaceably on the bolt 36 in front of the intermediate wall 25. The adjustment nut 37 forms a first spring support for the helical spring 41, and the intermediate wall 25 forms a second spring support, via the supporting ring 40 resting against its front side. Between the intermediate wall 25 and the bar 32, a stop ring 42 is fastened non-displaceably on the bolt 36 and forms a carry-along stop with the rear side of the intermediate wall 25. The rear end of the bolt 36, in turn, is provided with a thread, and the bolt bears a stop nut 43 behind the bar 32.

The helical spring 41, which, as has been mentioned, is supported on the intermediate wall 25 of the mount 21 via the supporting ring 40, exerts on the engagement tool 18, via the adjustment nut 37, a force which acts in the advancement direction. In the drawn-back position of the pusher 16, this position being shown in FIG. 2, the engagement tool 18 is thus advanced with respect to the pusher as far as the carry-along ring 42 allows. When, during advancement, the engagement tool 18 comes up against a fixed resistance, then it can be pushed back counter to the force of the helical spring 41 with respect to the mount 21. The spring force can be adjusted since the adjustment nut 37 can be displaced in the advancement direction by the bolt 36 being rotated by means of a screwdriver engaging with its front end. Displacing the adjustment nut 37 forwards relieves the pressure on the helical spring 41 and reduces the spring force, and displacing the nut rearwards increases the force.

The stop nut 43, whose diameter is greater than the width of the slot 33, forms, with the rear side of the bar 32, a engagement tool stop which limits the advancement of the engagement tool 18. When the advancement of the pusher 16 has reached this point, which can be adjusted by rotation of the stop nut 43 and corresponding longitudinal displacement of the same on the bolt 36, a relative displacement between the pusher 16 and the mount 21, on the one hand, and the engagement tool 18, on the other hand, thus commences.

Now, on its underside, the housing 34 has a profile 44 which runs essentially in the advancement direction and has a first profile section 45, parallel to the advancement direction, and, further forwards, a second profile section 46, which is located at a somewhat higher level with respect to the pusher 16 than the first profile section 45, and these two sections are separated by a downwardly oriented prong 47. A pressure-exerting spring 48, which is fastened on the underside of the pusher 16, is designed as a leaf spring and presses with sliding action against the upper side of the housing 34, presses the profile 44 onto an upwardly oriented lug 49 which is arranged at the bottom border of the recess 24 in the front wall 23 of the housing 34. The lug 49 may be formed by a wear-resistant exchangeable part screwed to the front wall 23 and may consist, for example, of brass. It is divided in two by a central recess. The force of the pressure-exerting spring 48 can be regulated by means of an adjustment screw 50. The interaction between the profile 44 and the lug 49 regulates the height position of the engagement tool 18 with respect to the pusher 16 during the final advancement of the pusher. As is explained in more detail below, the engagement tool 18 is guided in the mount 21 such that, after initially being advanced in parallel with the pusher 16, it is raised at the end of its advancement movement and then lowered again to a position which at least corresponds to the position assumed prior to the raising operation and is preferably at a somewhat lower level.

Figure 3:
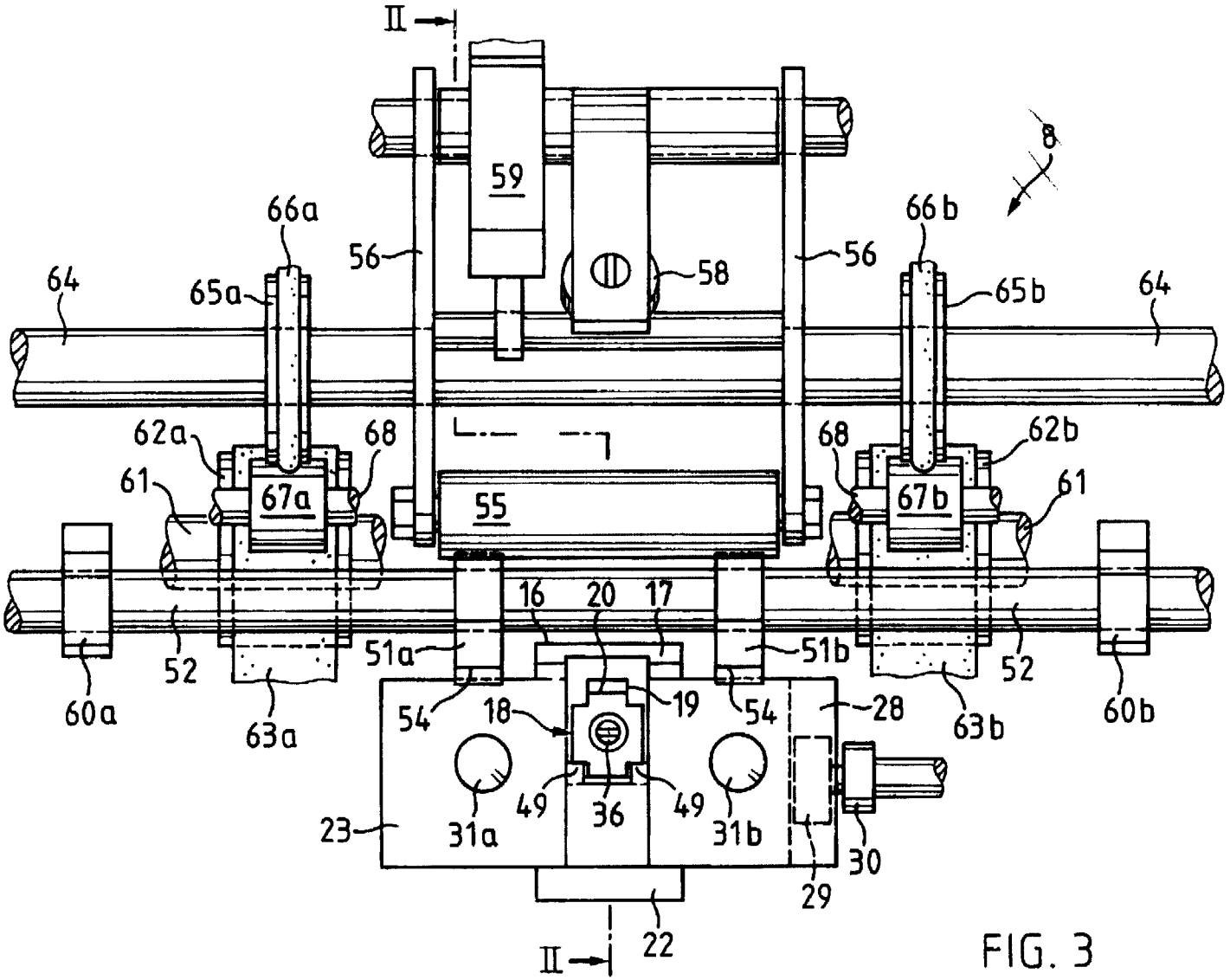
FIG. 3 shows a front view, in accordance with arrow III, of the part of the apparatus according to FIG. 2.

The withdrawal device 8 has two clamping elements (see also FIG. 3) which are designed as disc segments 51*a,b*. They are fastened on a common drive shaft 52. The partially cylindrical outer sections of the disc segments 51*a,b* form a clamping surface 53 which is delimited on one side by a lifting edge 54. On the inner side, the disc segments 51*a,b* are grooved to some extent following the lifting edge 54. The clamping surface 53 interacts with a mating element which is designed as a clamping roller 55 and is mounted rotatably in a pivotable mount 56, above the disc segments 51*a,b*, parallel to the shaft 52. The mount 56 is subjected to an elastic force by means of a helical spring 57, which can be adjusted by means of a knurled nut 58 and presses the clamping roller 55 against the disc segments 51*a,b*. A switch 59 is also provided and, when the distance between the clamping roller 55 and the clamping elements 51*a,b* reaches a limit value, switch 59, actuated by the mount 56, responds and stops the punching device. This makes it possible to avoid disruption to the paper transportation, e.g. paper accumulation in the transportation device 9. The limit value of the switch 59 can be adjusted.

Shaft 52 bears lifting elements 60*a,b* on either end of the shaft, outside of disc segments 51*a,b*. Lifting elements 60*a,b* are designed in a manner essentially corresponding to the disc segments 51*a,b*, but their lifting edges are offset with respect to those of the disc segments by 90° counter to the direction of rotation of the shaft 52, with the result that their lifting edges 54 follow those of the disc segments 51*a,b*.

In the region of the withdrawal device 8, the transportation device 9 has two rollers 62*a,b* which are provided on a common drive shaft 61 and via which flat transporting belts 63*a,b* run, the transporting belts 63*a,b* forming the first belt pair 10*a* (FIG. 1*a,b*). The transportation device also has two rollers 65*a,b* fastened on another drive shaft 64, via which transporting belts 66*a,b* of round cross-section are guided, which form the second belt pair 10*b*. Beneath the rollers 65*a,b*, two guide rollers 67*a,b* are provided on a resiliently mounted shaft 68.

Figure 4A:
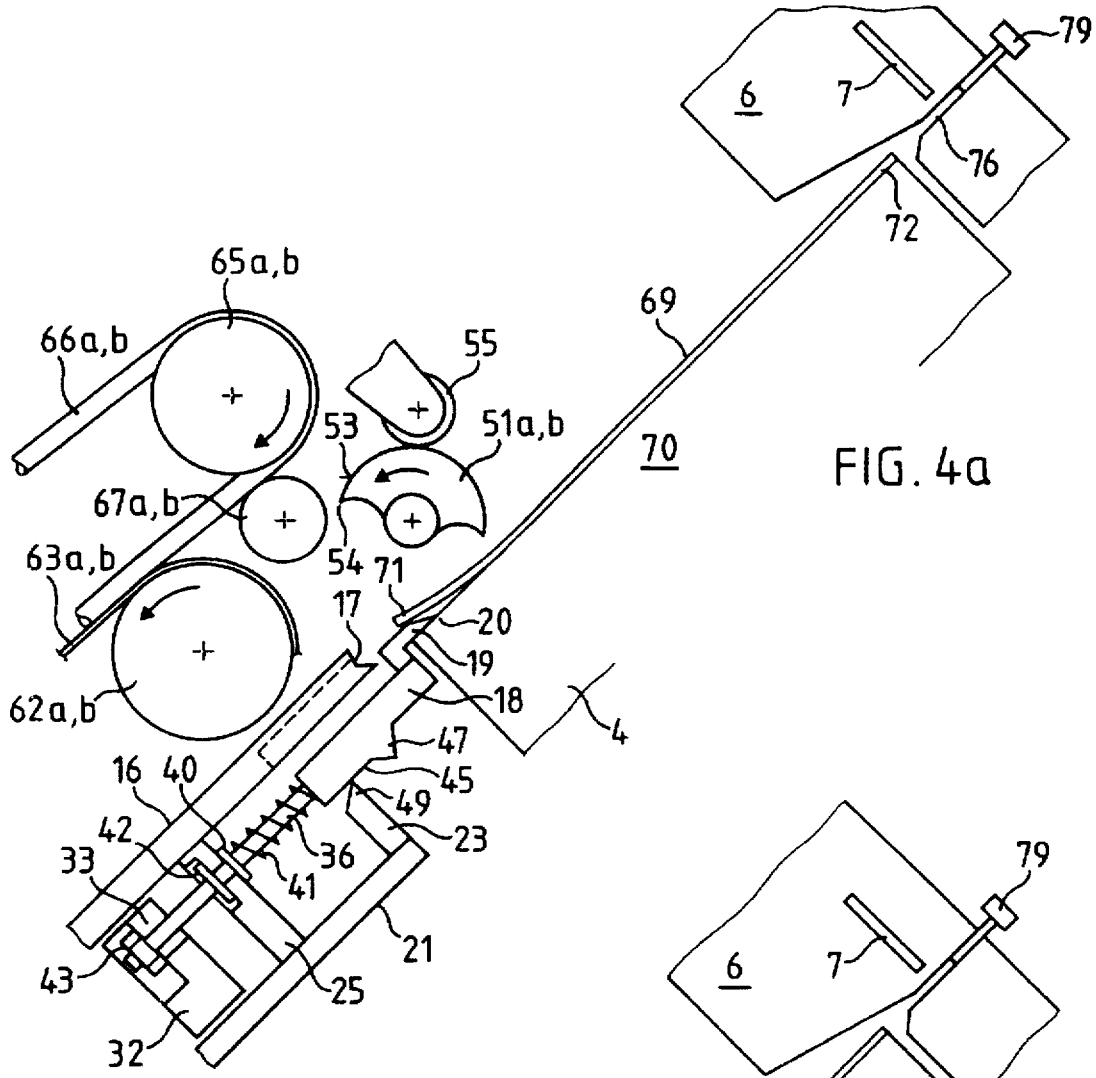
FIG. 4*a* shows a schematic and partially simplified view of the part of the apparatus according to FIGS. 2, 3 during a first stage of processing the bundles according to a method of the present invention by means of said apparatus.

The mode of operation of the above-described part of the punching device is explained below with particular reference to FIGS. 4*a–f* in which, parts which are not necessary for purposes of comprehension are not shown in all cases:

Rotation of the crank 30 advances the mount 21 together with the pusher 16 from the position illustrated in FIG. 2, the engagement tool 18 being carried along and penetrating, by means of the cutting edge of its nose 19, into the supply stack 4 and thus separating a bundle 69 from a residual stack 70. The penetration is damped to some extent by the resilient guidance of the engagement tool 18 in the mount 21. At the same time, the stop nut 43 reaches the bar 32. The engagement tool stop takes effect and prevents the engagement tool 18 from being carried along upon further advancement of the pusher 16 (FIG. 4*a*).

Figure 4B:
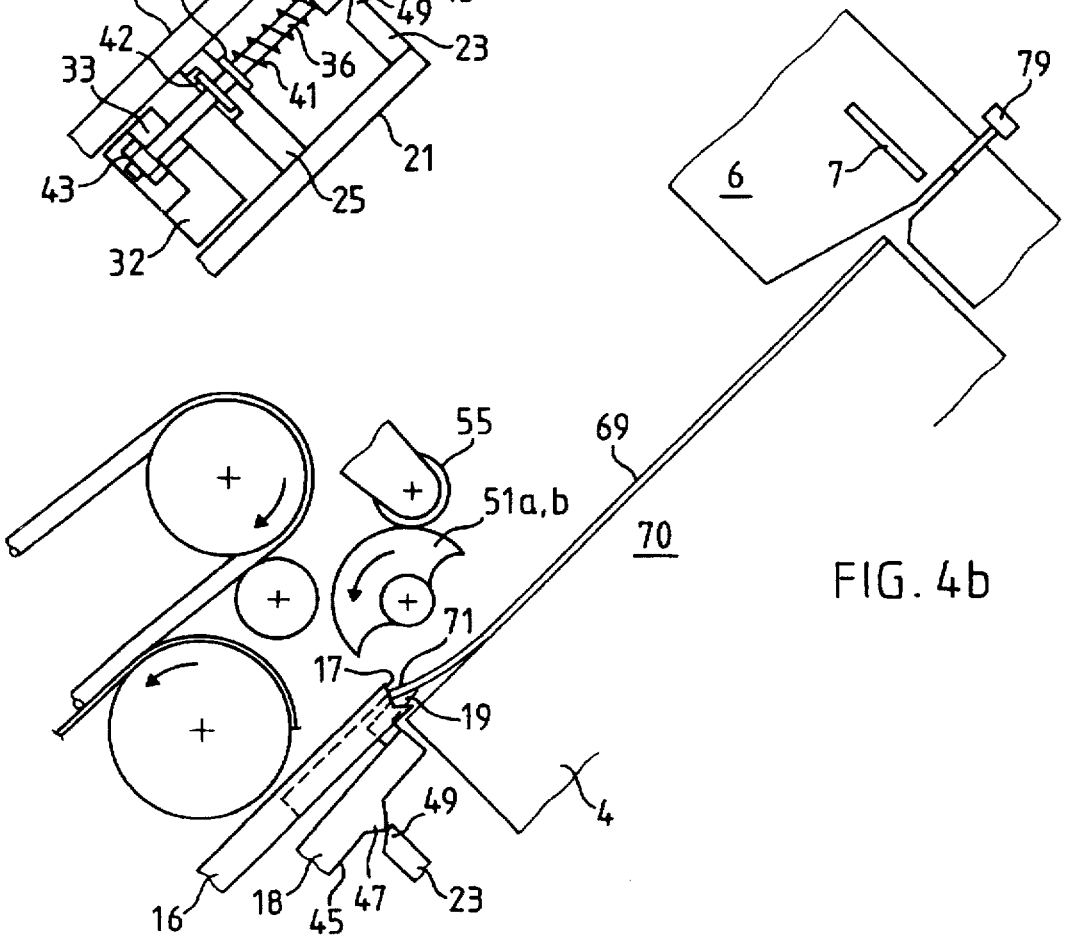
FIG. 4*b* shows, in a representation corresponding to FIG. 4*a*, a second stage of the method according to the invention.

Upon further advancement, the lug 49 thus slides along the first section 45 of the profile 44 on the underside of the housing 34 and ultimately comes up against the prong 47, which causes the engagement tool 18 to be raised rapidly. The engagement tool 18 causes the border region of the bundle 69 of sheets to be raised at the upper end of the supply stack 4 which is directed towards the pushing device 5, with the result that the border thereof—referred to as opposite border 71 hereinbelow—is gripped by the thrust surface 17 of the pusher 16, which is advanced over the supply stack 4 and, at this moment, catches up with the engagement tool 18 (FIG. 4*b*).

If the nose 19' is used, for example for the purpose of processing cardboard, then the spring of the engagement tool 18 is adjusted by means of the adjustment nut 37 to be comparatively weak, such that, when the end surface 20' butts laterally against the supply stack 4, it does not penetrate, but rather is pushed against said supply stack, with the result that, when the engagement tool 18 is raised, the opposite border of a bundle is raised along with it by virtue of friction.

Upon further advancement, the lug 49 is pushed beyond the prong 47, resulting in the engagement tool 18 being pressed downwards by the pressure-exerting spring 48 and assuming a slightly lower position than was the case prior to the raising operation. The engagement tool thus rests, by means of the underside of the nose 19, on the uppermost sheet of the residual stack 70 and clamps said sheet firmly, so that it is not possible for any sheets of the residual stack 70 to be drawn along when the bundle 69 is shifted, by way of further advancement of the pusher 16, such that its border region 72 which is to be processed passes into the punching device 6, while the remaining part of the bundle 69 rests largely on the residual stack 70 (FIG. 4*c*).

While holes are punched in the border region 72 by means of the punches 7, the disc segments 51*a,b* of the withdrawal device 8 rotate uniformly in the anticlockwise direction, grip beneath the opposite edge 71 of the shifted bundle 69 by means of the lifting edges 54 and raise further the region of the bundle adjacent thereto. (FIG. 4*d*).

Figure 4C:
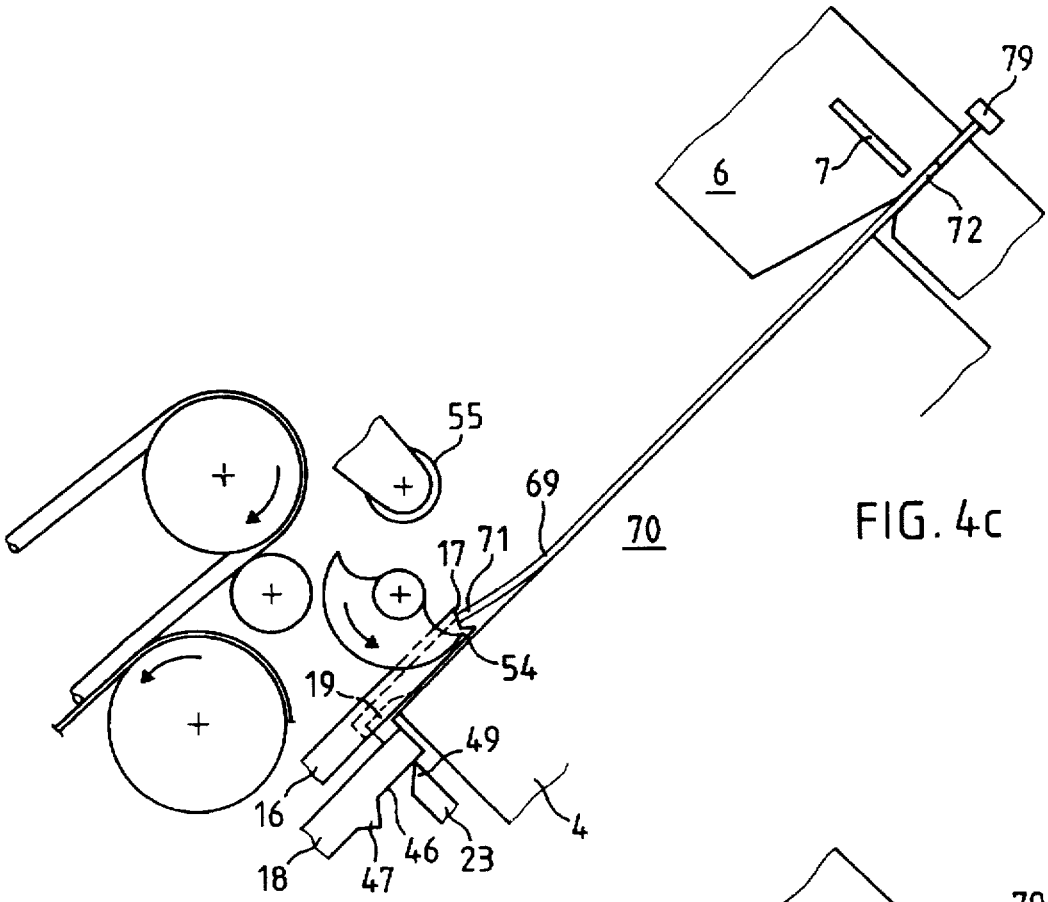
FIG. 4*c* shows a third stage of the method according to the invention.
Figure 4D:
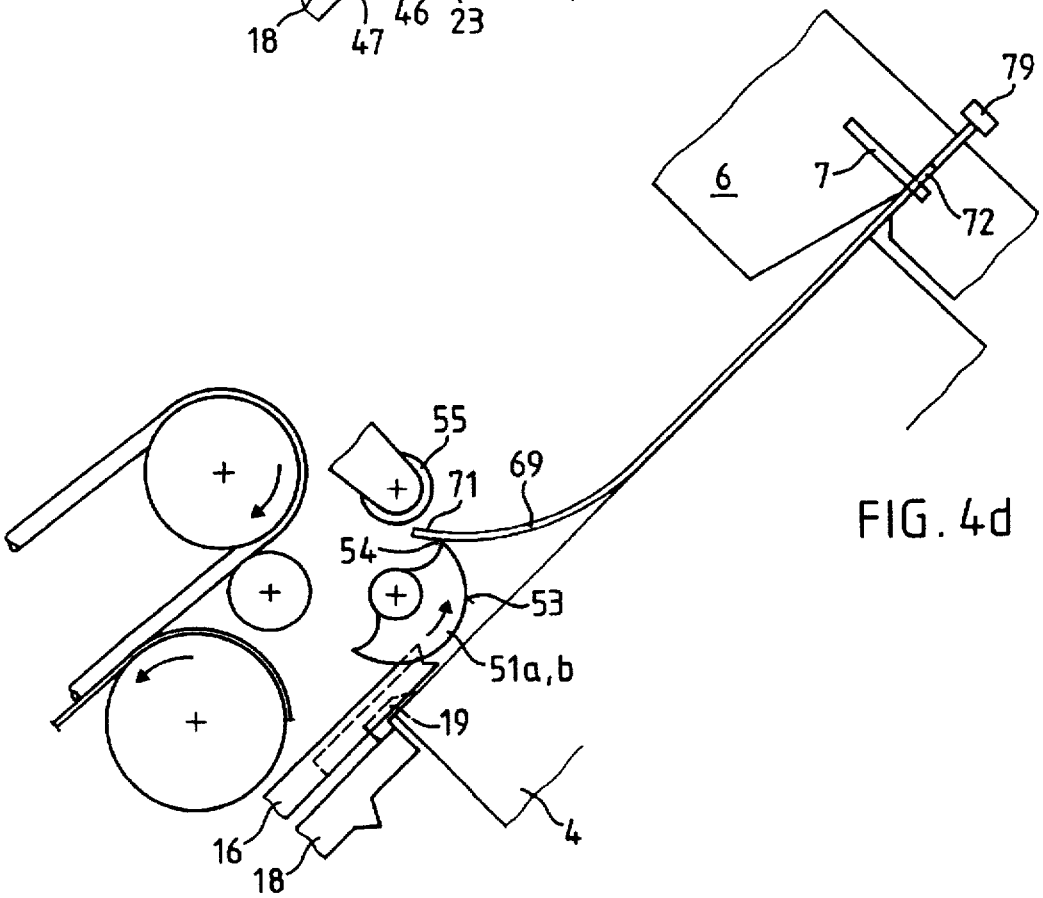
FIG. 4*d* shows a fourth stage of the method according to the invention.
Figure 4E:
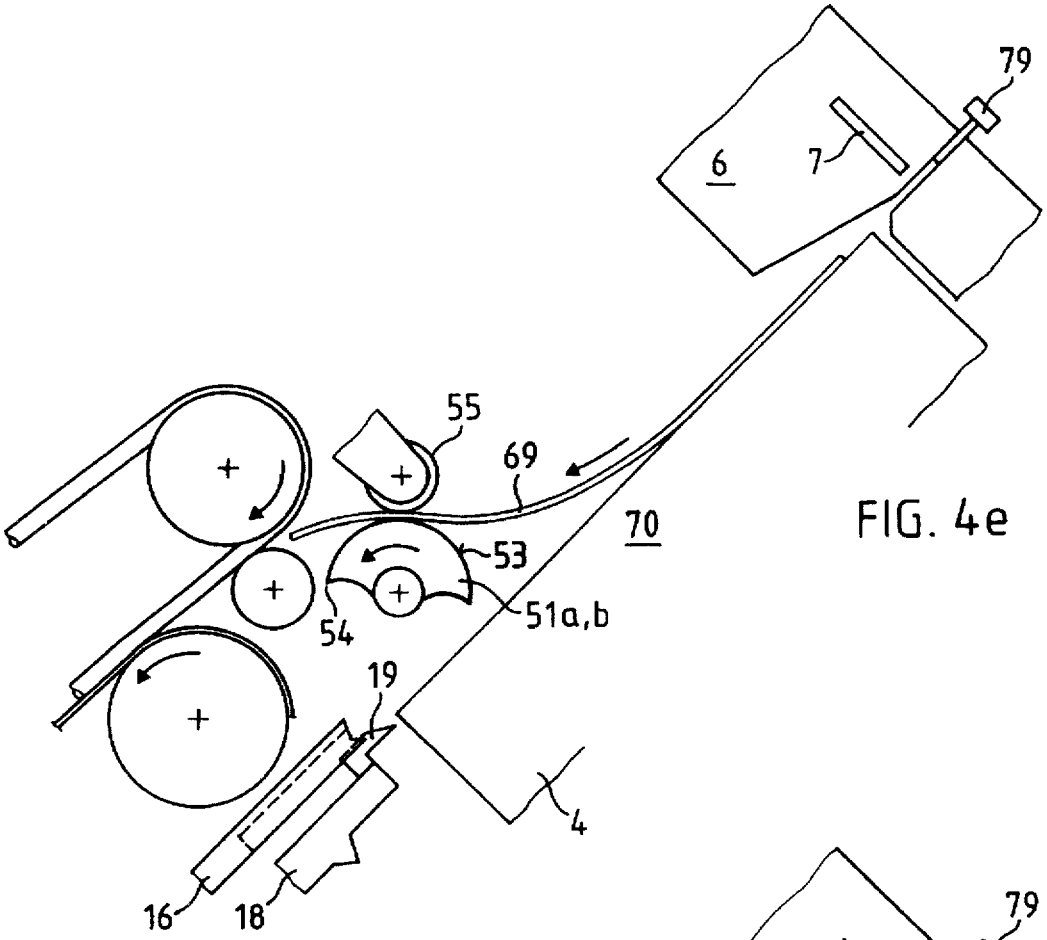
FIG. 4*e* shows a fifth stage of the method according to the invention.
Figure 4F:
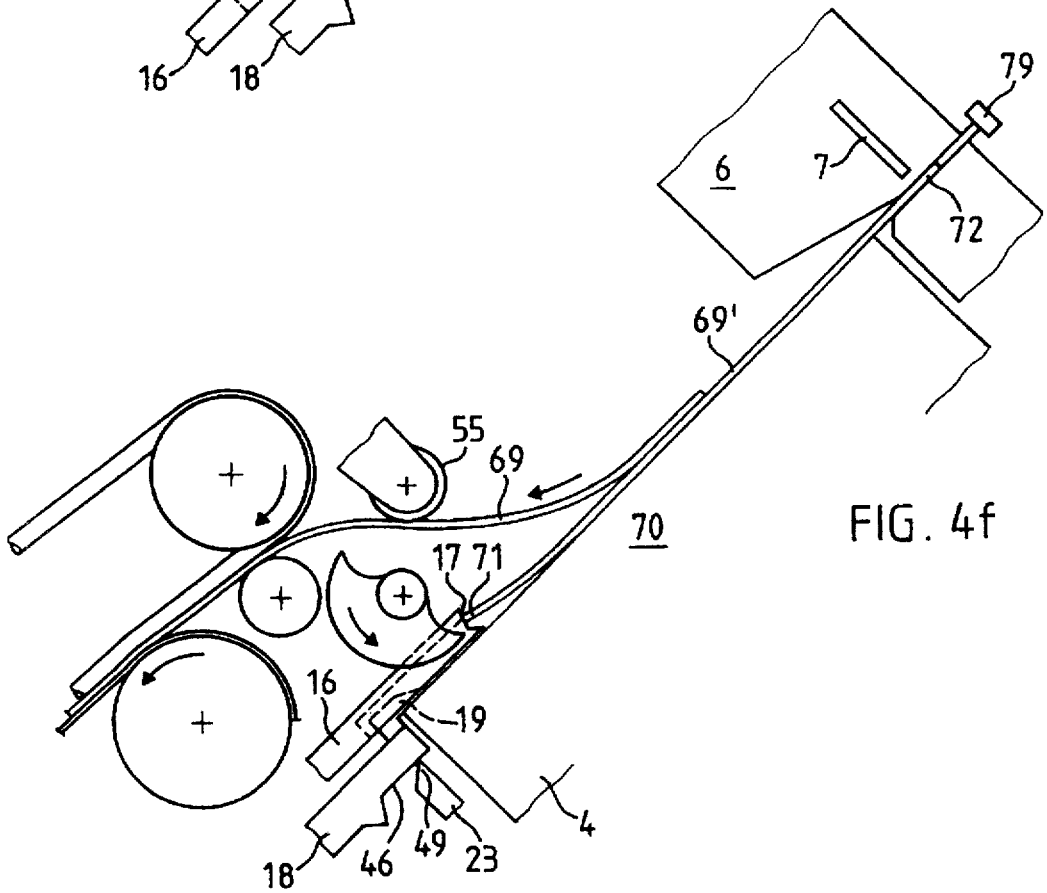
FIG. 4*f* shows a sixth stage of the method according to the invention.

While the punches 7 are drawn back, the region of the processed bundle 69 which adjoins the opposite edge 71 is raised by the lifting edge 54 up to the clamping roller 55 and clamped between the clamping roller 55 and the clamping surface 53 of the disc segments 51*a,b*, the clamping surface adjoining the lifting edge 54, and the bundle 69 is thus drawn out from the punching device 6 and fed to the transportation device 9 counter to the shifting direction (FIG. 4*e*). The corner regions of the bundle 69 are gripped by the lifting elements 60*a,b* (FIG. 2) a little time after the centre of the opposite border 71, these lifting elements thus assisting the raising of the bundle 69. Meanwhile, the pusher 16 has been drawn back by rotation of the crank 30, where, as soon as the intermediate wall 25 reached the stop ring 42, the carry-along stop took effect and the engagement tool 18 was drawn along with it.

While some of the drawn-out bundle 69 still rests on the residual stack 70, the supply stack 4 is raised by the thickness of a bundle (FIG. 4*f*) by means of the stack base 3 (FIGS. 1*a,b*), and another bundle 69' is raised by the re-advanced engagement tool 18 in the region of the opposite border 71 and is displaced by the thrust surface 17 of the pusher 16, with the result that its edge region 72, which is to be processed projects into the punching device 6, in which case the bundle 69' has reached a position corresponding to that of the bundle 69 in FIG. 4*c*.

It should be pointed out in this context that, in order to avoid crowding the Figures, the start of the process is illustrated in FIGS. 4*a–f*. Otherwise it would also be possible to see some of the bundles processed prior to the bundle 69.

Successive bundles 69, 69' are withdrawal by the drawing-out device 8, and fed to the transportation device 9, at a distance which is considerably smaller than the width of a bundle, and, once they have reached the transportation device 9, they are initially clamped between the transporting belts 66*a,b*, and the guide rollers 67*a,b*, and then clamped between the transporting belts 66*a,b* and the transporting belts 63*a,b* and transported to the end stack 13 such that they overlap in an imbricated manner. In this process, the bundles 69 are turned in order to maintain the order of the sheets. By virtue of being clamped between the transporting belts 66*a,b* and the somewhat offset guide rollers 67*a,b* at the beginning of the transportation device 9, the individual sheets of a bundle are displaced to some extent with respect to one another in each case, as a result of which any adherence between sheets resulting from the punching operation is eliminated.

The above-described way of drawing a bundle out of the processing region and transporting it may also be used together or separately, for inventive methods in which the sequence of steps is different from that outlined above or in which the bundles which are to be processed are shifted in some other manner, and also for methods and apparatuses of the generic type, in particular punching or stamping devices. It is also possible to use the way of shifting bundles with respect to the remaining residual stack in some other context, in particular some other implementation of the method steps. However, the combination which has been outlined is extremely favourable in terms of quickness and reliability of the processing and compactness of the apparatus.

Figure 5A:
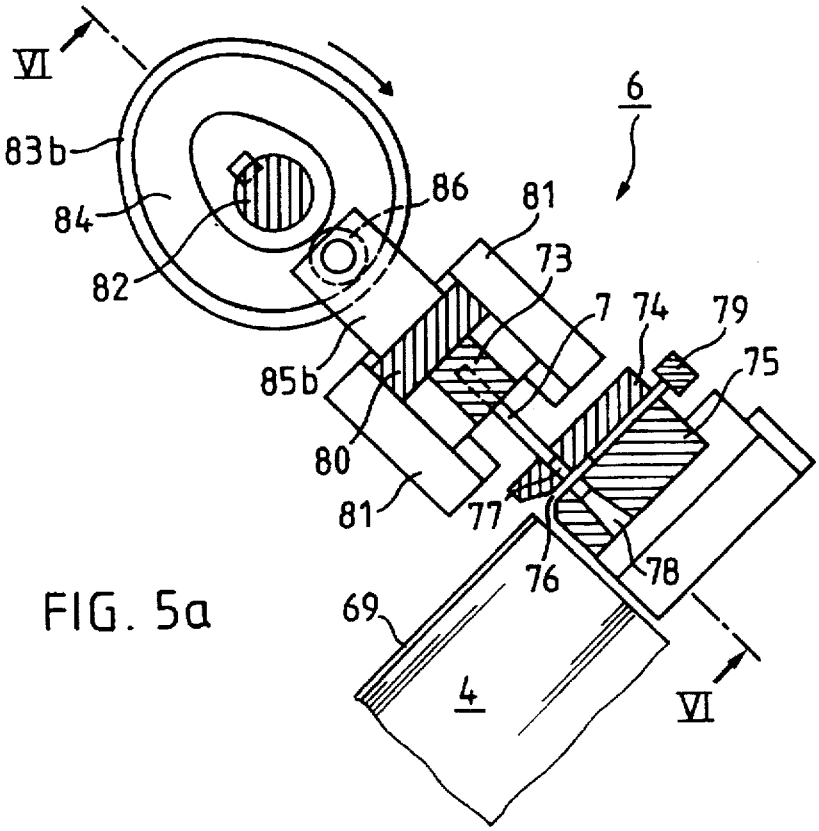
FIG. 5*a* shows a longitudinal section through a part of the apparatus according to the invention in the first stage of method of processing bundles according to FIG. 4*a*.

The punching device 6 comprises (FIGS. 5*a,b*, 6) a carrier 73 in which the punches 7 are mounted. A guide 74 and a die 75, which form between them a gap 76 for receiving the border regions 72 of bundles 69, which border regions are to be processed, have bores 77 and 78, respectively, for receiving the punches 7. On the side which is directed away from the supply stack 4, the gap 76 is delimited by an adjustable stop. The adjustable stop is formed by fingers of a displaceable adjustment bar 79 which project into the gap 76. The carrier 73 is screwed to a mount 80 which is mounted in a sliding guide 81 such that it can be displaced transversely with respect to the gap 76.

Provided for the purpose of driving the punching device 6 is an intermittently rotating shaft 82 which bears two drive parts which are designed as egg-shaped drive discs 83*a,b* and each bear, on the inner side which is directed towards the other drive disc, a continuous drive groove 84 which, following the outline of the respective drive disc, surrounds the shaft 82. Rollers 86 which project, in parallel with the shaft 82, from link plates 85*a,b* on the upper side of the mount 80 engage in the drive grooves 84.

Figure 5B:
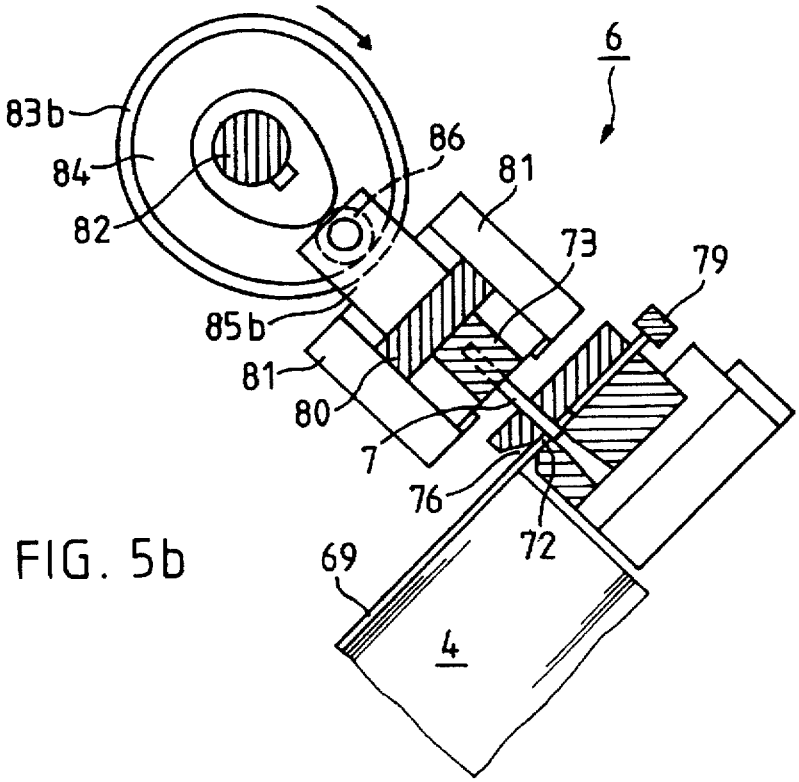
FIG. 5*b* shows, in a representation corresponding to FIG. 5*a*, the fourth stage of the method of processing bundles according to FIG. 4*d*.
Figure 6:
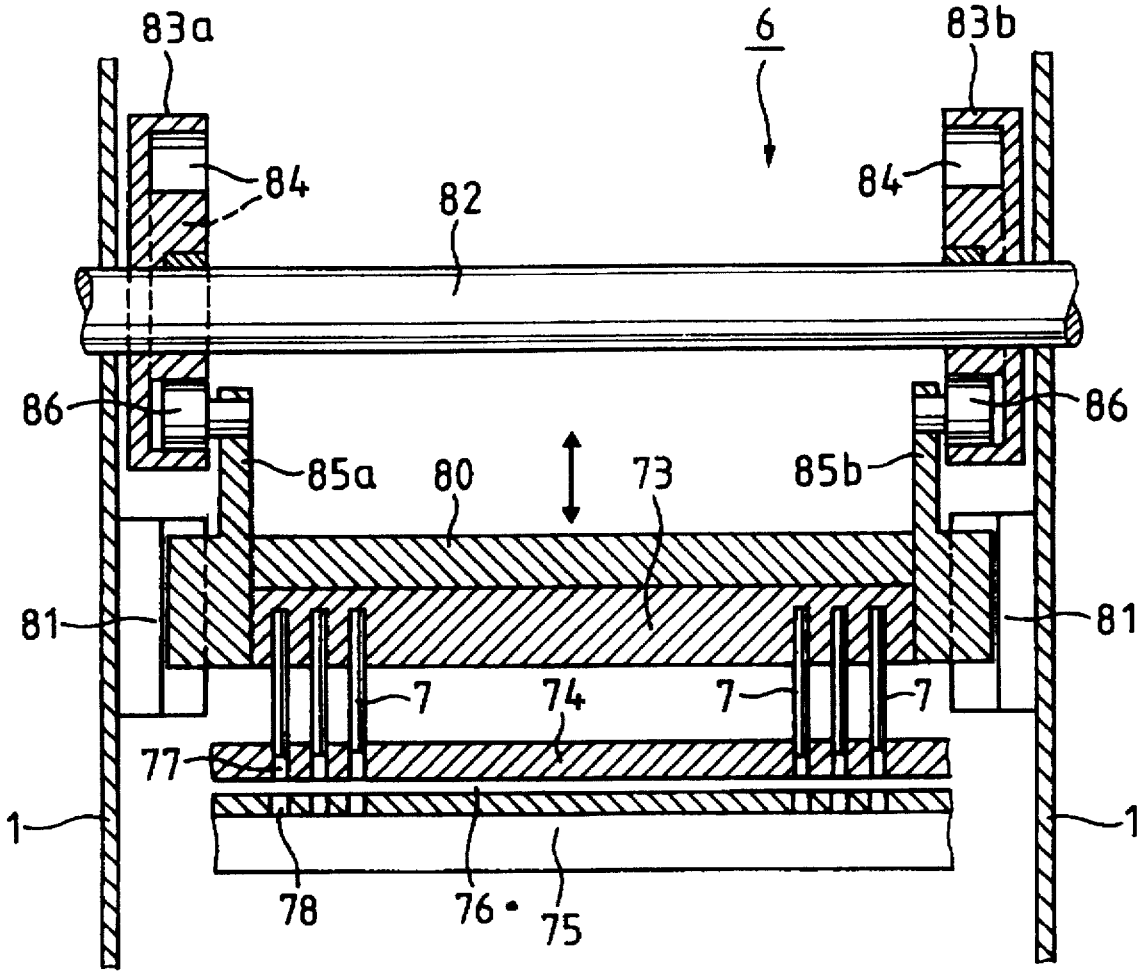
FIG. 6 shows a cross-section along VI—VI in FIG. 5*a*.

Starting from the basic position (FIG. 5*a*), in which the punches 7 are located in their upper limit position—the pushing device 5 assumes the drawn-back position illustrated in FIG. 2 —, after the border region 72 of a bundle 69 of sheets which are to be processed has been pushed into the gap 76 in the manner described in conjunction with FIGS. 4*a–c*, the shaft 82 is rotated and the rollers 86 are pressed downwards in each case by the cam-like protuberance of the inner wall of the drive groove 84. This causes a corresponding movement of the mount 80, of the carrier 73 and of the punches 7, with the result that said punches pass through the edge region 72 of the bundle 69, the edge region being located in the gap 76, and reach their lower limit position (FIG. 5*b*).

Upon continued rotation of the shaft 82, the rollers 86 are raised in each case by the outer wall of the drive groove 84. The retraction of the punches 7 into their upper limit position is thus forced by the movement of the shaft 82. The bundle 69 can then be drawn back, as is explained in conjunction with FIGS. 4*d–f*.

A drive which likewise forces the retraction of the punches 7 and is simpler, but cannot be controlled with the same precision, can be achieved by use of drive parts which are designed as cranks and are connected to the mount via connecting rods which are anchored rotatably on both sides.

In each case, the same type of drive may, of course, also be used in stamping devices, which, apart from the different design of the punches 7, may indeed be of virtually the same construction; and the same applies in conjunction with processes and apparatuses, in particular for punching or stamping, in which the the processing or shifting and transportation of the bundles is accomplished in a manner other than that outlined above.

The above-described operations take place automatically, without exception. The very short distances which a bundle covers from the supply stack to the processing area and upon retraction from the processing device, in order to free the latter for the next bundle, make possible a processing frequency which is at least 50% above that of known apparatuses of the generic type.

I claim:

1. An apparatus for processing successive bundles of sheets to be bound, each bundle comprising congruent sheets of a flat material which are separated from a stack of sheets to be processed at an edge region, said apparatus comprising:

an upwardly displaceable stack base for receiving the stack of sheets;

an edge processing device located on one side of the stack base;

a shifting device for shifting the bundles from the stack to said processing device, said shifting device including at least one shifting tool advanceable and retractable transversely over the stack base.

2. The apparatus of claim 1, wherein said shifting device is located on a side of the stack base opposite to the processing device; and wherein said shifting tool is a pusher having a thrust surface at an end thereof directed towards the stack base.

3. The apparatus of claim 2, wherein said shifting device includes an engagement tool which can be advanced and retracted beneath the shifting tool and transversely over the stack base, and wherein the engagement tool has a nose on a surface thereof for separating a bundle from the stack.

4. The apparatus of claim 3, wherein the engagement tool is limitedly displaceable in an advancement direction with respect to the shifting tool, and wherein the engagement tool is subject to a forward directed force by a spring element supported directly or indirectly on the shifting tool, and wherein the apparatus further comprises an engagement tool stop which, during final advancement of the shifting tool, restrains the engagement tool from moving along with the shifting tool.

5. The apparatus of claim 4 wherein the spring element is clamped between a first spring support on the engagement tool and a second spring support connected to the shifting tool, at least one of the supports being displaceable in order to regulate the spring force.

6. The apparatus of claim 5, wherein said first spring support is an adjustment nut which is mounted non-rotatably and engages with a rotatably mounted bolt of the engagement tool, the bolt extending substantially in the advancement direction.

7. The apparatus of claim 4, wherein the engagement tool interacts with the shifting tool via a profile and a lug, said lug sliding along the profile as a result of relative movement between the engagement tool and the shifting tool, the relative movement commencing after the engagement tool stop has been engaged.

8. The apparatus of claim 7 wherein a pressure exerting spring, acting between the shifting tool and engagement tool, pushes the lug and the profile against one another.

9. The apparatus of claim 7, wherein the profile is arranged on an underside of the engagement tool and wherein the lug is arranged in an upwardly projecting manner on a mount rigidly connected to the shifting tool.

10. The apparatus of claim 9, wherein said profile has a first profile section essentially parallel to the advancement direction, and a second profile section similar to the first section and arranged at a height equal to or higher than a level at which the first section is arranged; and wherein a downwardly oriented prong is located between the first and second profile sections.

11. The apparatus of claim 1, further comprising:

a withdrawal device for drawing the bundles out of the processing region in a direction counter to a shifting direction of the bundles.

12. An apparatus for processing successive bundles of sheets to be bound, each bundle comprising congruent sheets of a flat material which are separated from a stack of sheets to be processed at an edge region, said apparatus comprising:

an upwardly displaceable stack base for receiving the stack of sheets;

an edge processing device having a processing region;

a shifting device for shifting the bundles from the stack to said processing region; and a withdrawal device for drawing the bundles out of the processing region after processing.

13. The apparatus of claim 12, wherein the shifting device shifts the bundles from the stack to the processing region in a shifting direction and the withdrawal device draws the bundles out of the processing region in a direction counter to the shifting direction.

14. The apparatus of claim 12, wherein said withdrawal device further includes:

at least one clamping element rotatable about a horizontal axis of rotation, and substantially perpendicular to a shifting direction of the bundles;

wherein said at least one clamping element includes a lifting edge for engaging beneath and raising an opposite edge of said bundle;

said at least one clamping element having a partially cylindrical clamping surface adjoining the lifting edge; and said withdrawal device also having at least one mating element which is arranged above the clamping element and against which the raised bundle can be pressed by the clamping surface.

15. The apparatus of claim 14, wherein the at least one clamping element is a substantially cylindrical segment.

16. The apparatus of claim 12, further comprising at least two clamping elements fastened on a common drive shaft.

17. The apparatus of claim 16, wherein the clamping elements are disc segments.

18. The apparatus of claim 14 wherein the at least one mating element is a clamping roller.

19. The apparatus of claim 14 wherein the at least one mating element is connected to a switch responsive to changing a distance between the mating element and the at least one clamping element, wherein said switch responds when the distance exceeds a limit value.

20. An apparatus for processing successive bundles of sheets to be bound, each bundle comprising congruent sheets of a flat material which are separated from a stack of sheets to be processed at an edge region, said apparatus comprising:

an upwardly displaceable stack base for receiving the stack of sheets;

a processing device having a processing region;

a withdrawal device for drawing the bundles out of the processing region after processing;

a transportation device adjoining the withdrawal device for transporting the bundles via a transporting section, said transportation device having at least two belts guided in parallel for clamping the bundles between them.

21. The apparatus of claim 20 wherein the transporting section defines an arc of approximately 180 degrees for turning the bundles during transportation.

22. An apparatus for processing successive bundles of sheets to be bound, each bundle comprising congruent sheets of a flat material which are separated from a stack of sheets to be processed at an edge region, said apparatus comprising:

an upwardly displaceable stack base for receiving the stack of sheets;

a processing device having a processing region and including a displaceable processing tool connected to a driveable shaft in a positive locking manner such that a revolution of said shaft forces an up-and-down movement of the processing tool; and a withdrawal device for drawing the bundles out of the processing region after processing.

23. The apparatus of claim 22, wherein the shaft bears a drive part having a continuous groove which surrounds the shaft and in which a finger connected to the processing tool engages in parallel with the shaft.

24. The apparatus of claim 22, wherein the processing device is a punching device or a stamping device.

25. A method of processing successive bundles of sheets to be bound, each bundle comprising congruent sheets of a flat material which are separated from a stack of sheets to be processed at an edge region, said method comprising:

continuously shifting bundles of sheets from the stack such that the edge region of the bundle being processed is free from the stack while at least a portion of the bundle of sheets opposite the edge region overlaps the stack or a directly following bundle;

processing the edge region of each bundle of sheets; and withdrawing each bundle of sheets in a direction counter to the shifting direction after the edge region has been processed.

26. The method of claim 25 further including the steps of:

transporting each bundle via a transporting section; and turning each bundle as it is transported, wherein successive bundles are overlapping.

27. The method of claim 25 wherein the edge region of each bundle of sheets is processed immediately after shifting and said bundle is transported after processing.

28. The method of claim 27 wherein the bundle is shifted from an upper end of the stack, and wherein at least a portion of the bundle rests on the stack during processing.

29. The method of claim 25 wherein the shifting step includes:

displacing the bundle with respect to the stack by applying lateral action on the edge located opposite the edge region to be processed.

30. The method of claim 29 wherein the shifting step further includes:

prior to the displacement of the bundle, raising a region adjoining the opposite edge of the bundle.

31. The method of claim 30 further including the steps of:

clamping at least an uppermost sheet of the stack during displacement of the bundle.

32. The method of claim 25 wherein the step of withdrawing said bundle of sheets in a direction counter to the shifting direction includes drawing each bundle out of the processing region, successive bundles overlapping.

33. The method of claim 25 further including the steps of:

clamping between a clamping element and a mating element a region of the bundle which adjoins an edge opposite the edge region to be processed; and retracting the bundle after it has been processed by rotating at least one of the elements.

* * * * *